US009917387B2

(12) United States Patent
Bobbo et al.

(10) Patent No.: US 9,917,387 B2
(45) Date of Patent: Mar. 13, 2018

(54) CONNECTOR FOR LIGHTING DEVICES, CORRESPONDING ACCESSORY AND METHOD

(71) Applicant: OSRAM GmbH, Munich (DE)

(72) Inventors: Simon Bobbo, Mirano (IT); Lorenzo Baldo, Giavera del Montello (IT); Alberto Zanotto, Padua (IT)

(73) Assignee: Osram GmbH, Munich (DE)

( * ) Notice: Subject to any disclaimer, the term of this patent is extended or adjusted under 35 U.S.C. 154(b) by 0 days.

(21) Appl. No.: 15/161,289

(22) Filed: May 23, 2016

(65) Prior Publication Data

US 2016/0365656 A1 Dec. 15, 2016

(30) Foreign Application Priority Data

Jun. 10, 2015 (IT) ..... 102015000022416

(51) Int. Cl.

| | |
|---|---|
| ***H01R 24/00*** | (2011.01) |
| ***H01R 12/72*** | (2011.01) |
| ***F21V 21/002*** | (2006.01) |
| ***H01R 11/22*** | (2006.01) |
| ***F21S 4/20*** | (2016.01) |
| ***F21V 23/06*** | (2006.01) |
| ***H01R 13/20*** | (2006.01) |
| *H01R 12/81* | (2011.01) |
| *H01R 13/516* | (2006.01) |

(52) U.S. Cl.

CPC ..... *H01R 12/721* (2013.01); *F21S 4/20* (2016.01); *F21V 21/002* (2013.01); *F21V 23/06* (2013.01); *H01R 11/22* (2013.01); *H01R 13/20* (2013.01); *H01R 12/81* (2013.01); *H01R 13/516* (2013.01)

(58) Field of Classification Search

CPC .... H01R 12/57; H01R 13/26; H01R 23/6873; H01R 23/7068; H01R 23/725

USPC ..... 439/637, 636

See application file for complete search history.

(56) References Cited

U.S. PATENT DOCUMENTS 4,109,986 A * 8/1978 Mouissie ..... H01R 12/721 439/637
4,991,666 A * 2/1991 Septfons ..... H01L 21/4853 174/261

(Continued)

FOREIGN PATENT DOCUMENTS

| | | | |
|---|---|---|---|
| DE | 102011078096 | A1 | 12/2012 |
| DE | 102013109234 | A1 | 3/2015 |
| EP | 2416451 | A1 | 2/2012 |

OTHER PUBLICATIONS

Italian Search Report based on Application No. 102015000022416(7 Pages) dated Nov. 26, 2015 (Reference Purpose Only).

*Primary Examiner* — Abdullah Riyami
*Assistant Examiner* — Vladimir Imas
(74) *Attorney, Agent, or Firm* — Viering, Jentschura & Partner mbB

(57) ABSTRACT

In various embodiments, a connector for a lighting device is provided. The lighting device has a planar support with at least one electrical contact formation at an edge of the planar support. The connector includes a fork-shaped shell with a notch coupleable with said planar support edge with said planar support edge inserted in said notch, and an electrical contact structure on at least one side of said notch configured to provide electrical contact with an electrical contact formation on said edge inserted in said notch.

12 Claims, 7 Drawing Sheets

(56) References Cited

U.S. PATENT DOCUMENTS

| | | | | |
|---|---|---|---|---|
| 5,238,411 | A * | 8/1993 | Jinno | H01R 12/721 439/59 |
| 5,653,617 | A * | 8/1997 | Seidler | H01R 12/57 439/876 |
| 5,910,885 | A * | 6/1999 | Gulachenski | H01L 25/105 257/E25.023 |
| 6,220,881 | B1 * | 4/2001 | Murakami | H01R 12/721 439/262 |
| 6,234,822 | B1 * | 5/2001 | Gallin | H01R 13/26 439/260 |
| 6,751,862 | B2 * | 6/2004 | Hamatani | H01C 1/148 29/612 |
| 8,979,562 | B2 * | 3/2015 | Crighton | H01R 24/20 438/66 |
| 9,337,552 | B2 * | 5/2016 | Witte | G01R 1/0416 |
| 9,437,964 | B2 * | 9/2016 | Hwang | H01R 13/5812 |
| 2013/0040482 | A1 * | 2/2013 | Ngo | H01R 12/7023 439/328 |
| 2013/0040483 | A1 * | 2/2013 | Ngo | H01R 12/7023 439/328 |
| 2015/0111410 | A1 * | 4/2015 | Gingrich, III | H01R 12/771 439/358 |
| 2015/0280337 | A1 * | 10/2015 | Chawla | H01R 12/721 439/59 |

* cited by examiner

FIG. 7
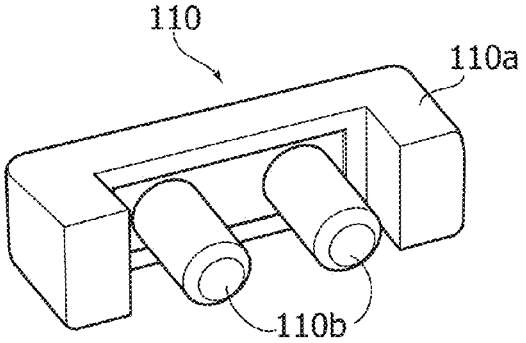
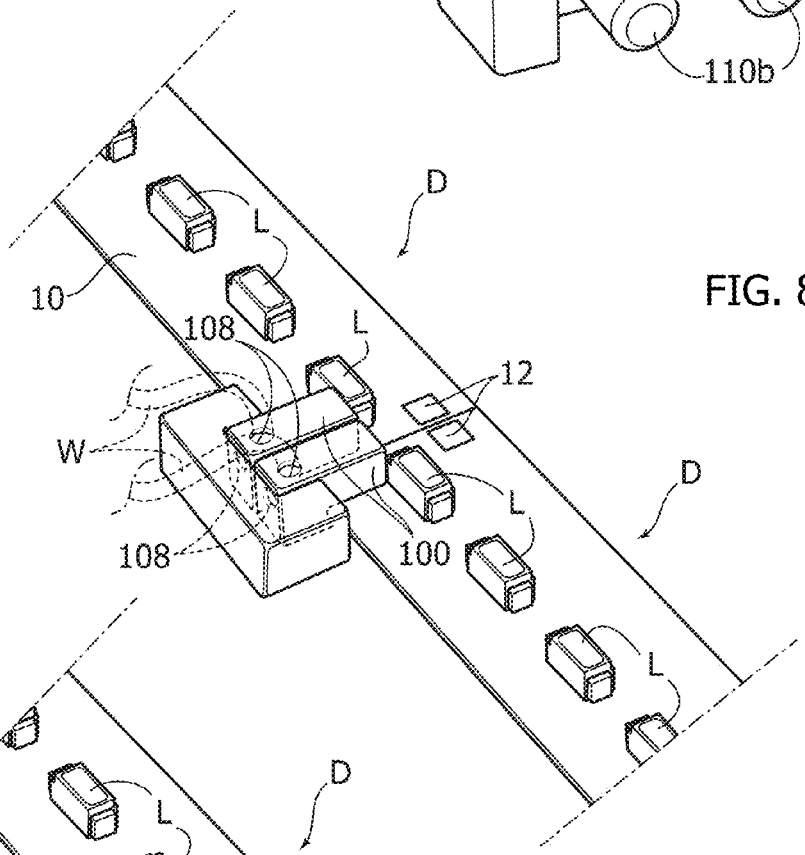
FIG. 8
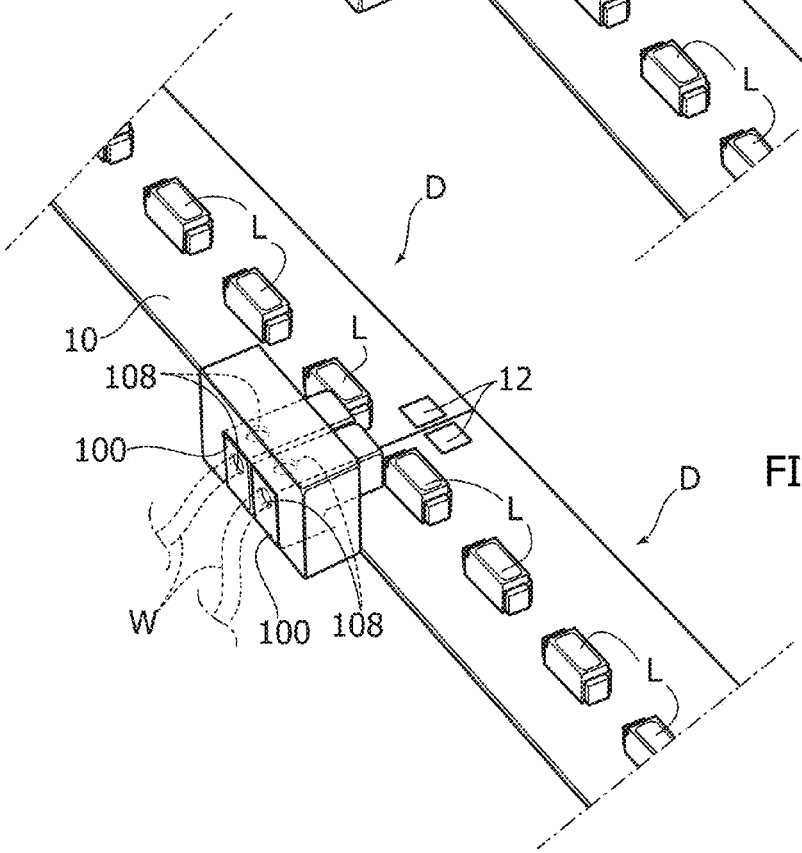
FIG. 9

CONNECTOR FOR LIGHTING DEVICES, CORRESPONDING ACCESSORY AND METHOD

CROSS-REFERENCE TO RELATED APPLICATION

This application claims priority to Italian Patent Application Serial No. 102015000022416, which was filed Jun. 10, 2015, and is incorporated herein by reference in its entirety.

TECHNICAL FIELD

The present description relates to lighting devices.

One or more embodiments may find application, e.g., in lighting devices employing electrically powered solid-state light radiation sources, such as LED sources.

BACKGROUND

In the field of lighting applications the use is spreading of lighting devices including a planar support (e.g. an optionally flexible ribbon-shaped support comparable to a Printed Circuit Board, i.e. a PCB), whereon there are arranged light radiation sources optionally provided with drive circuits.

For the power supply of such modules connectors may be used which may be coupled to the module extremities. Such connectors may be quite bulky and/or may have a fixed number of poles, so that they allow for a single position of the electrical connection. In the case of certain lighting modules (e.g. operating at 24 V), an electrical connector may therefore be coupleable only to one module extremity and not to the other (lest the exact match of colours and supply wires be lost).

Mounting the connector at an extremity may be disadvantageous e.g. when the module must be mounted with one or both extremities at corner positions, e.g. between two converging walls: in such conditions the extremity of the lighting module is located at an edge position within the dihedral angle formed by the walls.

SUMMARY

In various embodiments, a connector for a lighting device is provided. The lighting device has a planar support with at least one electrical contact formation at an edge of the planar support. The connector includes a fork-shaped shell with a notch coupleable with said planar support edge with said planar support edge inserted in said notch, and an electrical contact structure on at least one side of said notch configured to provide electrical contact with an electrical contact formation on said edge inserted in said notch.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which:

FIG. 7 shows an accessory adapted to be used in one or more embodiments;

FIGS. 8 and 9 show possible uses of the accessory of FIG. 7;

DESCRIPTION

Figure 1:
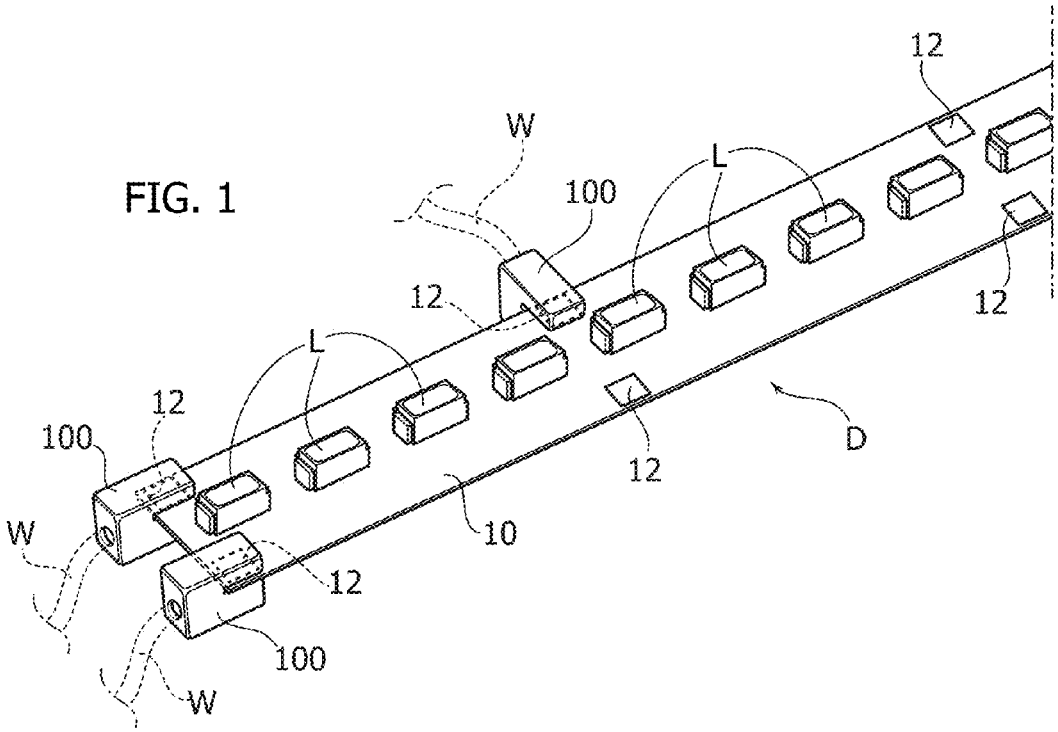
FIGS. 1 and 2 show possible uses of embodiments.
Figure 2:
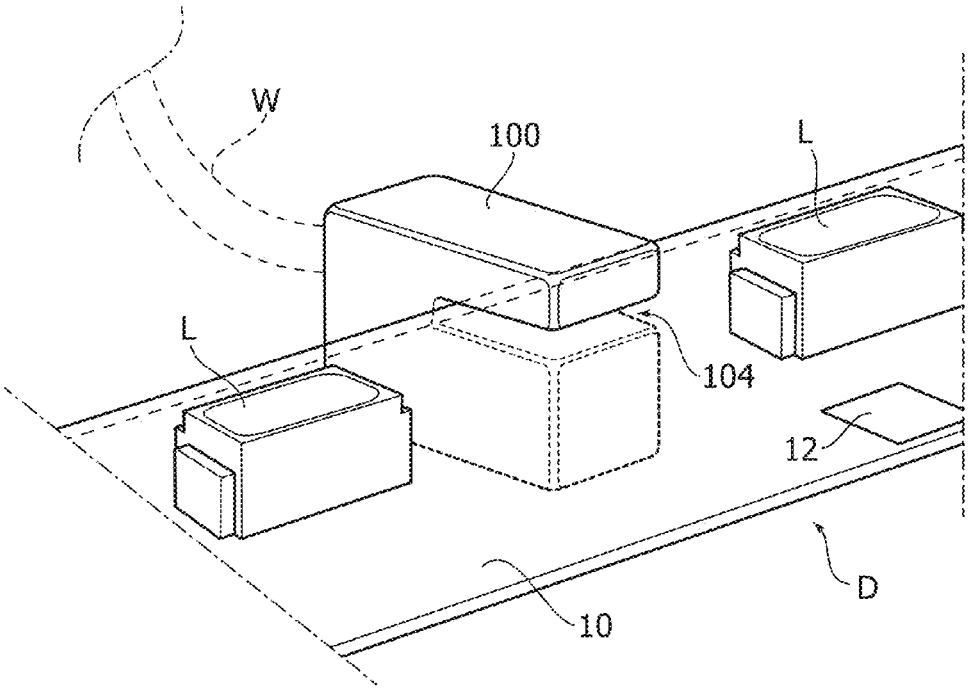

The following detailed description refers to the accompanying drawings that show, by way of illustration, specific details and embodiments in which the invention may be practiced.

In the following description, numerous specific details are given to provide a thorough understanding of one or more exemplary embodiments. One or more embodiments may be practiced without one or several specific details, or with other methods, components, materials, etc. In other instances, well-known structures, materials or operations are not shown or described in detail to avoid obscuring various aspects of the embodiments.

Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment. Furthermore, particular features, structures, or characteristics may be combined in any suitable manner in one or more embodiments.

The headings provided herein are for convenience only, and therefore do not interpret the extent of protection or scope of the embodiments.

Various embodiments may implement the electrical connection to a lighting module, e.g. a flexible (so called "flex") LED module, in an adjustable and versatile manner.

According to one or more embodiments, a connector is provided having the features specifically set forth in the claims that follow.

One or more embodiments may also refer to a corresponding accessory as well as to a corresponding method.

The claims are an integral part of the technical teaching provided herein with reference to the embodiments.

One or more embodiments provide a connector, e.g. a single pole connector, coupleable to the edges of a planar support (e.g. a PCB) at electrical contact formations, such as pads, provided on an edge of such a support.

One or more embodiments may lead to the achievement of a small-sized connector adapted to be coupled to one or both side edges and/or to one or both end edges of such a support, so as to obtain a reliable mechanical and electrical connection practically at any position on the module, and not only at the extremities.

One or more embodiments may offer flexibility features, because one and the same connector may be used together with any kind of lighting devices (e.g. flexible LED modules), i.e. devices emitting white, optionally tunable white, and RGB, optionally tunable RGB, even in configurations having 2, 3, 4, 5 or more poles.

One or more embodiments offer various connection options, both for a single device (e.g. a LED module) and for configurations providing a plurality of modules adapted to be connected to one another.

In addition to the previously outlined benefits, one or more embodiments may offer one or more of the following effects:

- the possibility of arranging the connector either in a parallel or in a transverse orientation with respect to the lighting device,
- versatility as regards the possible insertion of electrical wires in different positions, e.g. according to the needs or wishes of the installer/end user,
- the possibility of receiving electrical wires of various kinds as regards length, colour, section, insulation, again according to the needs or wishes of the installer/end user,
- the possibility of using the connector as a joining member between adjacent lighting devices, without originating shadow areas at joints,
- the possibility of using the connector also as an electrical (and optionally mechanical) connection bridge for a plurality of lighting devices,
- the possibility of supplying even lengthy LED modules, by splitting the supply lines into different branches, in such a way as to avoid overloading a single connector and/or a single module, e.g. as regards the electrically conductive tracks provided thereon.

In the Figures, D generally denotes a lighting device including, as known per se:

- a planar support 10 including e.g. a ribbon-shaped plate or board substantially comparable to a Printed Circuit Board (PCB), which may be flexible, and
- an array, e.g. a linear array, of electrically powered light radiation sources L; in one or more embodiments, the latter may be e.g. solid-state light radiation sources, such as LED sources.

In a way known per se, the power supply to sources L may be implemented (optionally with the addition of "smart" control/drive functions) via electrical lines provided on support 10. Such electrical lines are not visible in the Figures, with the exception of electrical contact formations such as pads 12 which are variably arranged (on one or optionally on both sides of support 10) in correspondence of at least one of the lengthwise edges (or of the end edges) of support 10.

The phrase "in correspondence of" means that electrical contact formations 12 may be located either exactly on the (lengthwise or end) edge of support 10 or in the vicinity of such edge.

One or more embodiments may refer to a connector 100 adapted to implement the electrical (and optionally mechanical) connection of one or more devices D as previously exemplified.

Figure 3:
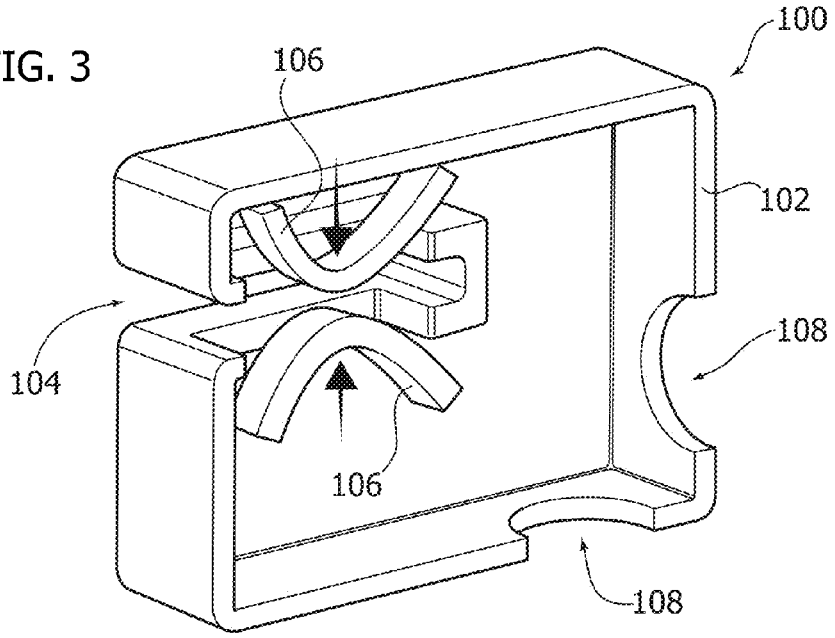
FIG. 3 is a view of an embodiment shown in a cross section along a middle plane.

In one or more embodiments, connector 100 includes a shell 102 adapted to have a box-like, substantially hollow structure, as exemplified in FIG. 3. In one or more embodiments, shell 100 may have the shape of a prism, e.g. a parallelepiped.

Irrespective of the specific implementation details (the shell may be hollow, or solid, or partially solid, the shape may be optionally different from a parallelepiped), in one or more embodiments shell 102 may have a fork-like shape, and therefore may have a groove or notch 104 coupleable to planar support 10 of device D, when the edge of planar support 10 is inserted into the groove or notch 104.

In other words, in the coupling position to device D, as visible in the Figures, fork-shaped shell 102 of connector 100 may be applied astride one of the edges of support 10.

As can be seen e.g. in FIG. 3, FIG. 11, FIG. 12 and FIG. 13, in one or more embodiments electrical connector 100 also includes electrical contacts 106, e.g. metal contacts, mounted on shell 102 (e.g. by fitting or in any suitable manner), which are arranged on one or both opposed sides of groove or notch 104. Moreover, the possibility is given to clamp the edge of support 10, inserted into groove or notch 104, and to establish an electrical contact with one or more electrical lines provided on support 10, e.g. with one of the formations 12.

In one or more embodiments as exemplified in FIG. 3, contact or contacts 106 may be arch-shaped resilient bodies, which are mounted laterally of groove or notch 104 of shell 102, so that the convexity of the arch shape faces groove or notch 104.

Figure 11:
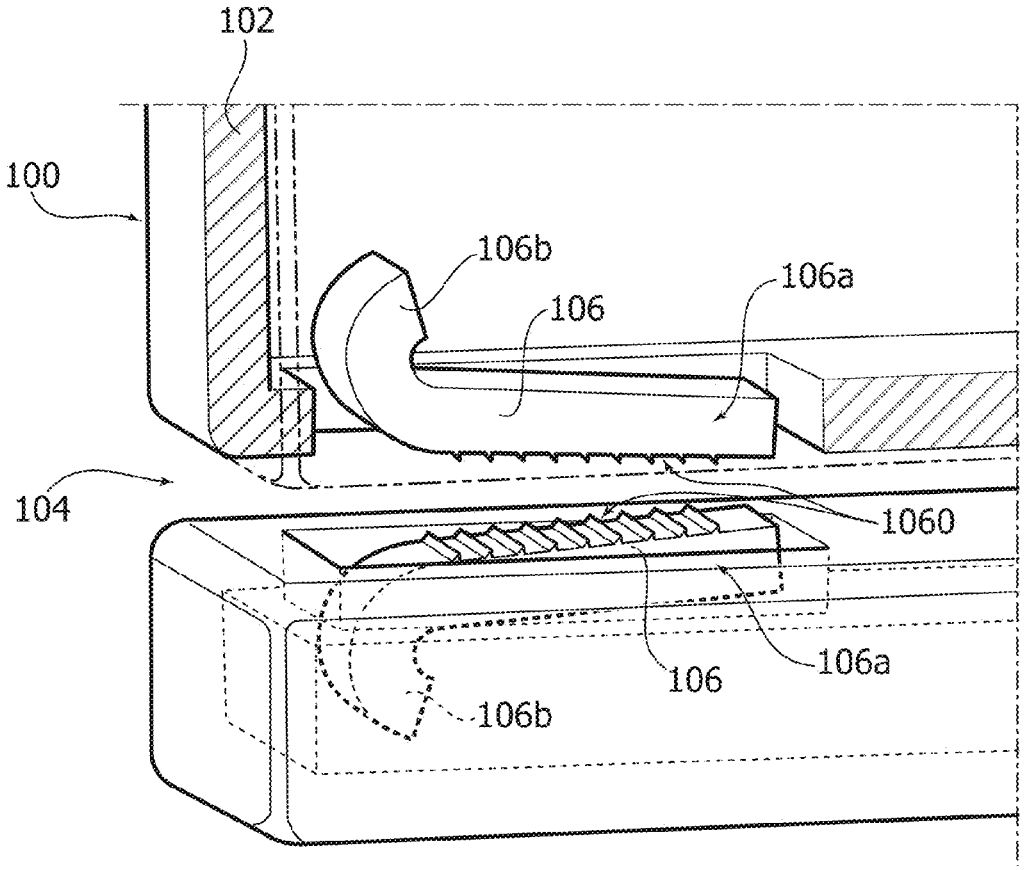
FIG. 11 exemplifies a possible modification of one or more embodiments.
Figure 12:
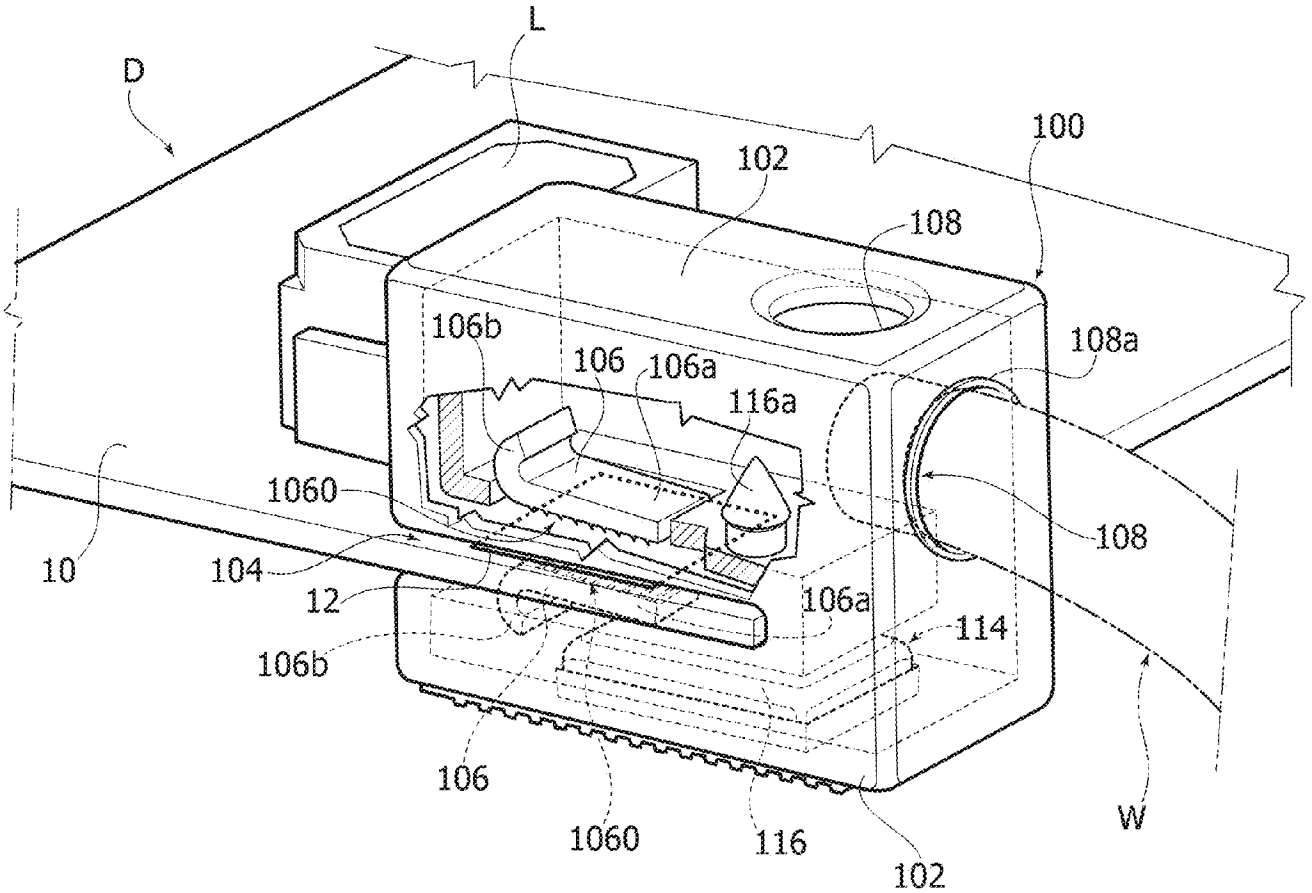
FIGS. 12 and 13 show a further possible modification of embodiments.
Figure 13:
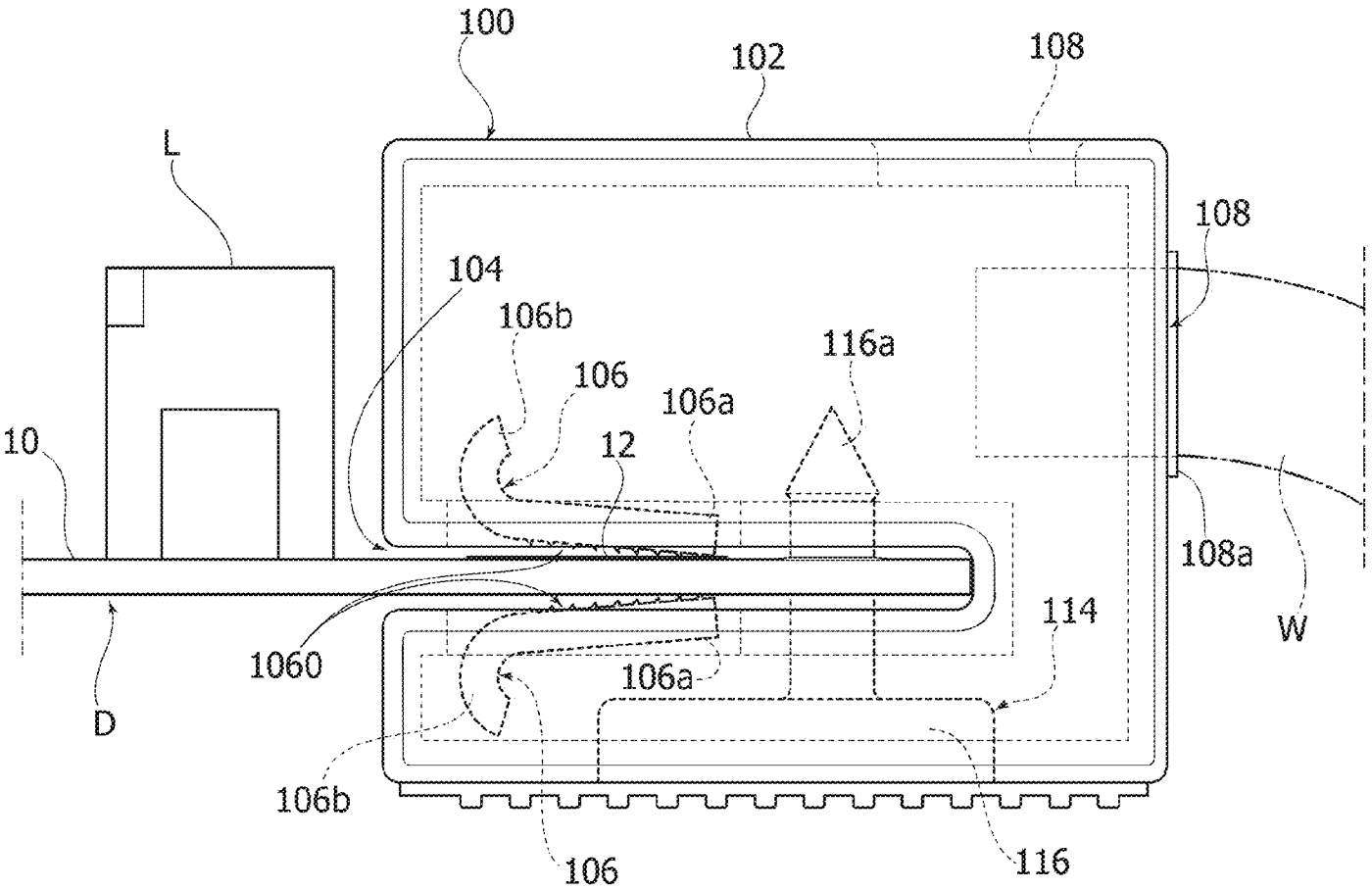

In one or more embodiments as exemplified in FIG. 11 to FIG. 13, contact(s) 106 may have a so to say "walking stick" profile, having a linear portion **106*a* extending parallel to the side of groove or notch 104 (e.g. with a protrusion inwardly of groove or notch 104 which increases while advancing inwardly of shell 102) and an arcuate end portion 106*b***.

In one or more embodiments as exemplified in FIG. 11 to FIG. 13, wherein there are provided two such contacts 106, linear portions **106*a* may therefore converge while advancing inwardly of shell 102, while arcuate end portions 106*b*** diverge in opposite directions.

In one or more embodiments, arcuate portion **106*b* may act as an anchoring member to shell 102, while the straight portion 106*a* may be a resilient formation adapted to perform a retention function on the lateral edge of support 10. For example, in one or more embodiments as exemplified in FIG. 11 to FIG. 13, wherein two contacts 106 are present, converging straight portions 106*a* may form a sort of floating clamp, which is adapted to retain the side edge of support 10** therein.

As can be appreciated e.g. in the view of FIG. 11, in one or more embodiments each contact 106 may be provided with a surface sculpturing, e.g. in correspondence of straight portion **106*a*. In one or more embodiments, such surface sculpturing 1060 may be implemented as sawtooth profiled projecting ribs, with the steeper side of the sawtooth profile facing inwardly of the connector shell 102. In one or more embodiments, thanks to such a configuration the force required to fit connector 100 onto the side or edge of support 10 may be lower than the force needed to detach connector 100 from support 10**.

In this way a definite retention action may be achieved, in order to retain connector 100 in the mounting position on support 10 of device D.

A similar retention effect (however with no difference between the coupling and the uncoupling directions of connector 100 to or from device D) may be achieved by imparting a different surface sculpturing to contacts 106 (whatever their shape may be), e.g. sawtooth profiled projections with symmetrical sides, providing a roughness adapted to achieve a certain friction on the surface of support 10.

A complementary effect of surface roughness may be provided on support 10 by implementing e.g. a surface roughness of formations (pads) 12, so as to achieve a retention action of connector 100.

Such a result may be obtained in different ways, e.g. via electrodeposition (ED) of a material such as copper, so as to produce an increased surface roughness than achievable in rolling-annealing (RA) laminating processes, or with the deposition of a soft metal material such as tin onto formations 12, with a subsequent surface scratching treatment of formations 12, or with a selective surface etching (e.g. via micro-etching techniques) of the metal material, e.g. copper, of formations 12.

Figure 4:
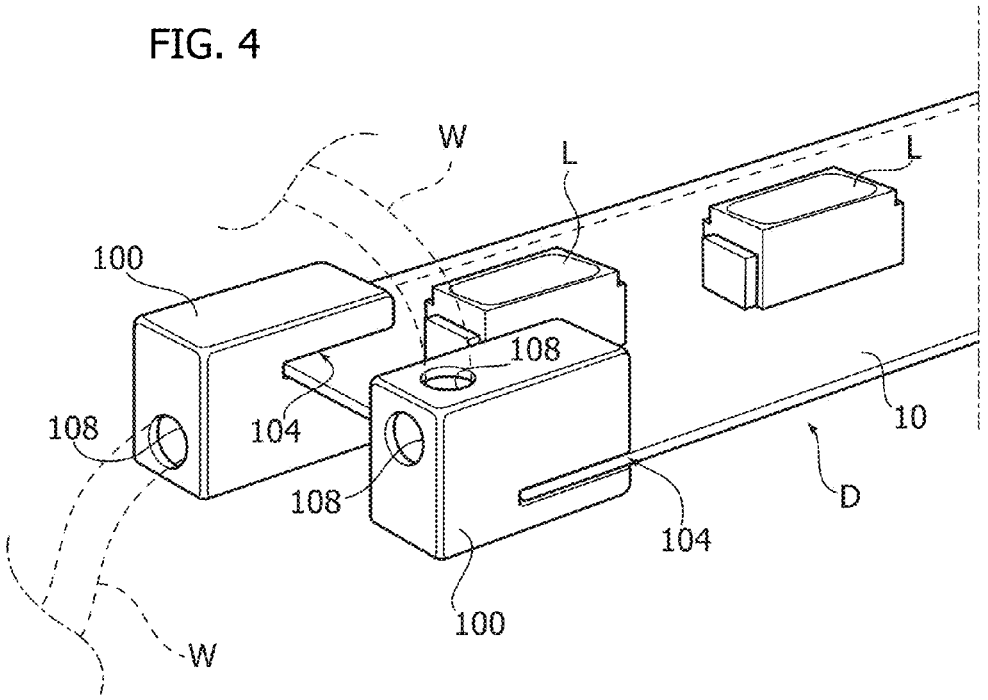
FIGS. 4 to 6 exemplify further possible uses of embodiments.

Figures such as FIG. 1 exemplify that connectors such as connector 100 may be coupled with any edge of support 10, therefore both with a lengthwise edge and with an end edge, while FIG. 4 highlights that, in one or more embodiments, groove or notch 104 may be arranged off-center with respect to shell 102 of connector 100.

In such embodiments, shell 102 of connector 100 may therefore have an asymmetrical fork shape, allowing for two possible mounting positions on support 10, which are mutually reversed by 180°, as exemplified in FIG. 4. In this way the option is given to choose the coupling position of connector 100 on the edge of support 10, so that the volume of shell 102 of connector 100 projects more from one side of support 10, while having a smaller projection on the opposite side; in this way the possibility is given to choose the side or face of support 10 where a larger projection is desired.

In one or more embodiments, shell 102 may be provided with at least one opening 108 (e.g. a hole) allowing for the passage towards the interior of shell 102, i.e. towards contact(s) 106, of wires or cables for the electrical connection, as denoted with W in the Figures.

In one or more embodiments, shell 102 may be provided with a plurality of openings 108 (e.g. two openings, in the embodiments shown in the Figures) which may be arranged at different positions or areas of shell 102. In this way a connection may be established with contact(s) 106 and a wire or cable W, while choosing a desired position and direction from at least two different options, according to the needs of the installer/user.

For example, in the case of a shell as shown in the Figures, openings 108 may be arranged in a "rear" region and in an "upper" region, both opposed to groove or notch 104. In one or more embodiments as shown in the Figures, in the case of a parallelepiped-shaped shell 102, openings 108 may be provided in two mutually perpendicular walls of shell 102, so as to originate equally perpendicular insertion directions of wires or cables W, e.g. the former being co-planar and the latter being normal to support 10.

As shown in the Figures, wires or cables W may be associated to sealing members 108*a*. The holes 108 which are not used may be left empty, or optionally closed with a plug.

Figure 5:
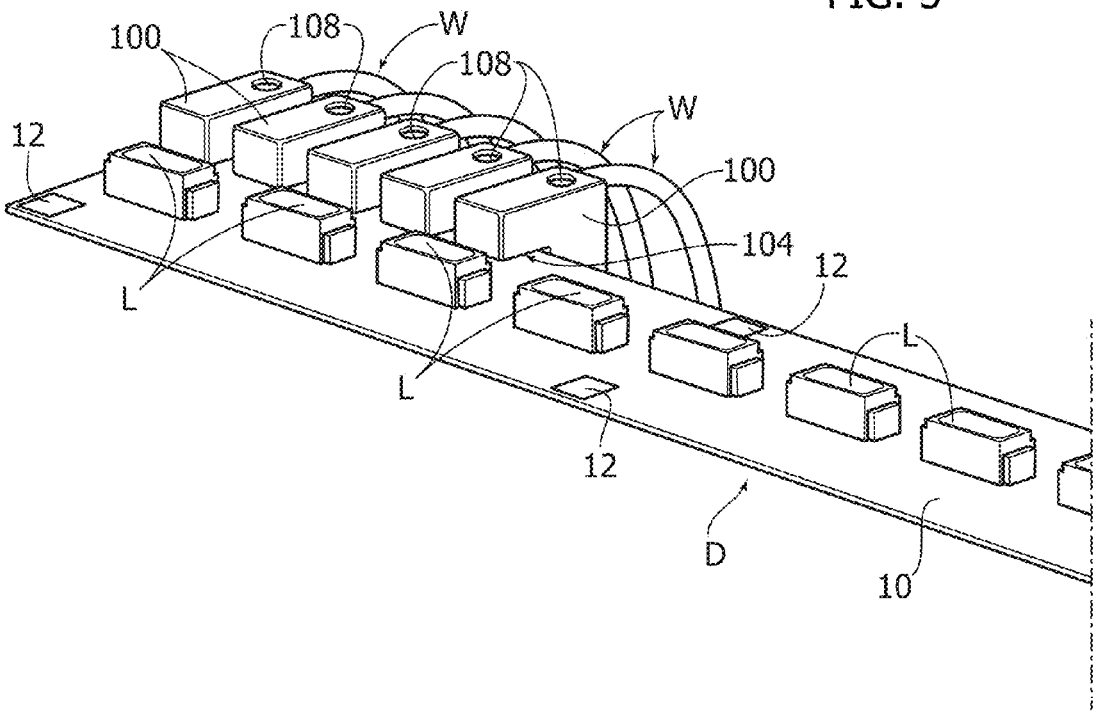

FIG. 1 and FIG. 5 exemplify the wide range of possible choices as regards both the possible location and the number of connectors 100. The connectors may be placed virtually at any position on the edge of support 10 adapted to implement the electrical contact, e.g. thanks to the provision of a pad 12.

FIG. 6 to FIG. 9 exemplify the possibility of using a connector 100 according to one or more embodiments in order to implement the electrical (and optionally mechanical) connection among a plurality of lighting devices (modules) D.

Figure 6:
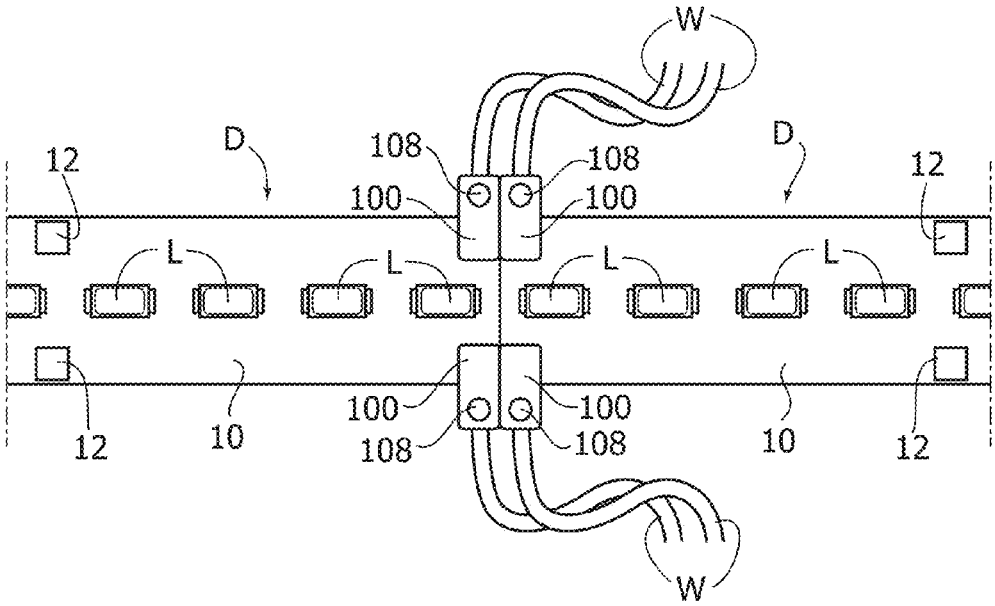

For example, FIG. 6 shows that connectors 100 with respective wires or cables W may enable establishing an electrical connection between two adjacent modules D, e.g. by mutually connecting wires W or cables of connectors 100 located on the same side of two adjacent modules D.

In one or more embodiments, the parallelepiped shape of shell 102 (or, more generally, the fact that shell 102 has planar opposed sides) enables arranging two connectors 100 side by side (optionally abutting one against the other) in conditions wherein both connectors 100 are coupled or "pinched" on respective adjoining edge portions of planar supports 10 of two adjacent devices D.

In one or more embodiments, the electrical connection may be associated to a mechanical connection, by resorting to accessory 110 exemplified in FIG. 7, the use whereof is exemplified in FIG. 8 and FIG. 9.

In one or more embodiments, accessory 110 may have at least one of (and, in the example shown in FIG. 7, both) the following features:

- accessory 110 includes an arch-shaped (i.e., C-shaped) body 110*a*, adapted to be applied astride two connectors 100 adjacent to each other (e.g. abutting against each other) at mutually facing ends of two adjacent modules D, so as to mechanically retain connectors 100, and therefore modules D, together;
- accessory 110 includes a pair of pins 110*b* adapted to be inserted into shells 102 of said adjacent connectors 100, pins 110*b* being adapted to be dimensioned e.g. so that they may be inserted into a pair of adjacent holes 108, which are available e.g. because they are not used for the passage of a wire or cable W), retaining once again both connectors 100 together (and through them keeping both modules D united) also from a mechanical point of view.

FIG. 8 and FIG. 9 highlight the possibility of choosing the mounting position of accessory 110 so that it does not interfere with wires or cables W, e.g. in those embodiments wherein each of adjacent connectors 100 is provided, in corresponding positions, with a plurality of apertures 108, wherein pins 110*b* of accessory 110 may be inserted.

In one or more embodiments, accessory 110 may include (similarly to what has been described for contacts 106), surface sculpturing formations, e.g. with a sawtooth profile, so as to further facilitate the retention action performed by accessory 110 on connectors 100 coupled thereto.

Figure 10:
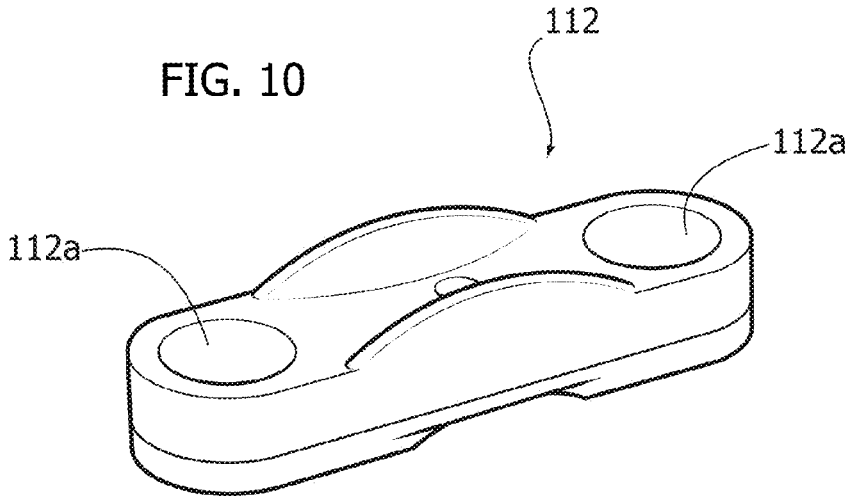
FIG. 10 shows a further accessory adapted to be used in one or more embodiments.

After installing module(s) D and connectors 100, they may be fixed e.g. by a clamp such as clamp 112 shown in FIG. 10, which is provided with openings 112*a* for fixation.

FIG. 12 and FIG. 13 show moreover the possibility of configuring a connector 100 according to one or more embodiments (e.g. by providing shell 102 with a cavity 114), so that it can receive a plug element 116 including at least one penetrating (e.g. perforating) member such as a sharp pin 116*a*. The latter may then be inserted into connector shell 102 by traversing the edge of support 10 received in the groove or notch 104, so as to pierce it and to achieve a firm mechanical coupling, adapted to retain connector 100 on said edge.

In one or more embodiments, as exemplified herein, connector 100 is a single-pole connector, adapted to offer a high degree of flexibility in implementing various connections, according to the application needs and by using a corresponding number of connectors 100, such as a two-pole connection for white light or one-colour applications with direct supply (constant current or constant voltage), three-pole configurations, e.g. for a module with tunable colour, four-pole configurations for LEDs with multiple colours, such as RGB, or optionally with an even higher number of poles (see e.g. the five-pole connection exemplified in FIG. 5).

One or more embodiments may envisage a connector 100 with multiple poles.

One or more embodiments offer a high flexibility in the choice of size, length, colour, arrangement, etc. of wires or cables W, and/or the possibility (which is e.g. exemplified in FIG. 6, FIG. 8 and FIG. 9) of implementing a connection (e.g. a "butt" connection) of a plurality of modules, without originating shadow areas.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A connector for a lighting device having a planar support with at least one electrical contact formation at an edge of the planar support, the connector comprising:

a fork-shaped shell with a notch coupleable with said planar support edge with said planar support edge inserted in said notch;

an electrical contact structure on at least one side of said notch configured to provide electrical contact with the electrical contact formation on said edge inserted in said notch; and a plug element comprising at least one penetrating member;

wherein the fork-shaped shell comprises a cavity for receiving the plug element whereby the plug element is insertable into the fork-shaped shell by traversing the edge of the planar support received in said notch.

2. The connector of claim 1, wherein the electrical contact structure is on both sides of said notch.

3. The connector of claim 1, further comprising:

a resilient electrical contact structure configured to clamp said planar support edge inserted in said notch.

4. The connector of claim 1, wherein said notch is located off-center said shell, whereby said fork-shaped shell is asymmetric and coupleable in opposed positions with said planar support edge.

5. The connector of claim 1, wherein said shell includes at least one insertion opening for an electrical contact wire towards said electrical contact structure.

6. The connector of claim 5, wherein said shell includes a plurality of insertion openings for an electrical contact wire towards said electrical contact structure, said openings of said plurality of openings being provided at different locations of said shell.

7. The connector of claim 1, wherein said electrical contact structure includes surface sculpturing facing said notch, said sculpturing preferably including sawtooth profiled protrusions with the steeper side of the sawtooth profile facing inwardly of the connector.

8. The connector of claim 7, wherein said sculpturing comprises sawtooth profiled protrusions with the steeper side of the sawtooth profile facing inwardly of the connector.

9. The connector of claim 1, wherein said shell comprises opposed planar faces, whereby a pair of said connectors are suited for being located side-by-side with said pair of connectors coupled with respective adjacent planar support edge portions.

10. An accessory for use with one or more electrical connectors, each electrical connector comprising:

a fork-shaped shell with a notch coupleable with said planar support edge with said planar support edge inserted in said notch; and an electrical contact structure on at least one side of said notch configured to provide electrical contact with an electrical contact formation on said edge inserted in said notch;

said accessory comprising:

an arch-shaped body applicable astride the connectors in said pair of connectors located side-by-side to retain them together; and a pair of pins insertable into the shells of the connectors in said pair of connectors located side-by-side to retain them together.

11. The accessory of claim 10, wherein said shell of each connector includes at least one insertion opening for an electrical contact wire towards said electrical contact structure; and wherein said pins are dimensioned for insertion in said at least one opening in the shell.

12. A method of providing electrical connection of one or more lighting devices having a planar support with at least one electrical contact formation at an edge of the planar support, the method comprising:

providing at least one connector, the at least one connector comprising:

a fork-shaped shell with a notch coupleable with said planar support edge with said planar support edge inserted in said notch;

an electrical contact structure on at least one side of said notch configured to provide electrical contact with the electrical contact formation on said edge inserted in said notch; and a plug element comprising at least one penetrating member;

wherein the fork-shaped shell comprises a cavity for receiving the plug element whereby the plug element is insertable into the fork-shaped shell by traversing the edge of the planar support received in said notch;

coupling said at least one connector with said planar support with said edge inserted in said notch.

* * * * *